US007865118B2

(12) United States Patent
Nakagawa et al.

(10) Patent No.: US 7,865,118 B2
(45) Date of Patent: Jan. 4, 2011

(54) DEVELOPING DEVICE FOR IMAGE FORMING APPARATUS AND PROCESS CARTRIDGE HAVING THE SAME

(75) Inventors: Shuuichi Nakagawa, Suita (JP); Ryuji Inoue, Itami (JP); Shin Murayama, Sanda (JP); Kazushige Ohnishi, Hitachi (JP); Shintaro Yamada, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 8 days.

(21) Appl. No.: 12/320,760

(22) Filed: Feb. 4, 2009

(65) Prior Publication Data

US 2009/0208252 A1 Aug. 20, 2009

(30) Foreign Application Priority Data

Feb. 15, 2008 (JP) ..... 2008-034646

(51) Int. Cl.
*G03G 15/08* (2006.01)

(52) U.S. Cl. ..... 399/281; 399/284

(58) Field of Classification Search ..... 399/279, 399/281–286

See application file for complete search history.

(56) References Cited

U.S. PATENT DOCUMENTS 6,343,201 B1 * 1/2002 Wada et al. ..... 399/281

FOREIGN PATENT DOCUMENTS

| | | |
|---|---|---|
| JP | 08-220872 | 8/1996 |
| JP | 08-248770 | 9/1996 |
| JP | 3197934 | 6/2001 |

OTHER PUBLICATIONS

Abstract of JP 05-273848 published Oct. 22, 1993.

* cited by examiner

*Primary Examiner*—Hoang Ngo
(74) *Attorney, Agent, or Firm*—Harness, Dickey & Pierce, P.L.C.

(57) ABSTRACT

A developing device that can reliably supply toner from a toner supply roller to a developing roller and that does not generate scraping irregularities in the toner thin layer on the developing roller, and a process cartridge and an image forming apparatus having the same. The developing device has: a toner supply chamber; a developing roller provided in the toner supply chamber; a toner supply roller provided in the toner supply chamber for supplying toner to the developing roller; and a layer regulation member for forming the toner on the developing roller into a thin layer, and develops electrostatic latent images on an image carrier by applying bias voltage to the developing roller. An intermediate contact member is interposed between the developing roller and the toner supply roller. The intermediate contact member is a sheet member fixed at one end, and the free end of the sheet member is interposed between the developing roller and the toner supply roller, with the free end side protruding therebetween.

11 Claims, 6 Drawing Sheets

DEVELOPING DEVICE FOR IMAGE FORMING APPARATUS AND PROCESS CARTRIDGE HAVING THE SAME

BACKGROUND OF THE INVENTION

1. Field of the Invention

The present invention relates to an image forming apparatus such as a copy machine, facsimile apparatus, printer, or an apparatus that combine these, and more specifically relates to a developing device utilized in these apparatuses and to a process cartridge that has this developing device.

2. Description of the Related Art

In the past, developing devices were used in order to develop an image carrier surface by following an electrostatic latent image pattern formed on the image carrier surface. Concretely, the developing device had a toner housing chamber for housing toner, a developing roller provided in the toner housing chamber for supplying toner to the image carrier, a toner supply roller provided in the toner housing chamber for supplying toner to the developing roller, and toner layer regulating means for forming a thin layer of toner on the developing roller by making contact with the developing roller; and had the function of developing an electrostatic latent image on the image carrier by applying bias voltage to the developing roller.

In order to obtain a high quality image without concentration irregularities, the amount of toner adhering to the developing roller had to be sufficient to form the toner image, and that the toner had to be uniformly charged. However, in one-component non-magnetic developing devices using non-magnetic toner, toner could not adhere to the developing roller by magnetic force because no magnetic body was contained, and therefore, the amount of adhering toner was prone to be insufficient.

In order to resolve this issue of an insufficient amount of adhering toner, proposed in Japanese Unexamined Patent Application Publication H 5-273848, for example, is a developing device composed of a toner supply roller with a foam surface such that toner can be copiously supplied to the developing roller, and toner is coated on and supplied to the developing roller surface by the developing roller making contact with the toner supply roller that contains a large amount of toner. More concretely, by making the foam density in the range of 0.18 to 0.28 g/cm$^3$ and making the amount of compression deformation of the toner supply roller with the contact part of the developing roller be in the range of 0.2 to 1.5 mm, this is a technology that can guarantee satisfactory supply performance while avoiding increased torque caused by excess pressure contact.

Moreover, disclosed in Japanese Unexamined Patent Application Publication H 8-220872 is a technology that, when a toner supply roller composed of foam rotates while contacting the developing roller, toner contained inside the foam cells is blown out without being cut off evenly by a toner layer formation member, and generation of images with stripe-shaped light and dark irregularities on the image is prevented. More concretely, a developing device was proposed that prevents images with light and dark irregularities by mathematically formulizing the relationship between the toner fluidity index and such toner supply roller conditions as cell density and amount of indentation.

However, in the conventional developing devices disclosed in the patent publications described above, uneven contact is caused by the contours of the foam cells of the toner supply roller, and the toner supply roller generates scraping irregularities on the thin layer of toner already adhering to the developing roller, and induces triboelectric charge irregularities. This phenomenon tends to occur when the amount of toner saturation charge increases and the electrostatic adsorption force of the toner onto the surface of the developing roller is heightened, such as in low humidity environments. The toner newly supplied when toner supply roller has made scrapes has insufficient charge and also has weak electrostatic adsorption force, and therefore the developing characteristics of the image carrier are uneven, and light and dark noise corresponding to the contoured pattern of the cells appears on the image.

Technologies relating to the present invention are also disclosed in e.g., Japan Patent No. 3197934.

SUMMARY OF THE INVENTION

Thus, as a result of assiduously studying the problems above, it is an object of the present invention to provide a developing device and process cartridge of the same that can precisely supply toner from the toner supply roller to the developing roller, and that does not generate scraping irregularities in the thin layer of toner on the developing roller.

In an aspect of the present invention, a developing device for developing electrostatic latent images on an image carrier comprises a toner supply chamber for housing toner; a developing roller, which is provided in the toner supply chamber and applied with bias voltage, and which supplies toner to an image carrier; a toner supply roller, which is provided in the toner supply chamber, and which supplies toner to the developing roller; a toner layer regulation device for forming, in contact with the developing roller, the toner on the developing roller into a thin layer; and an intermediate contact member interposed between the developing roller and the toner supply roller.

In another aspect of the present invention, a process cartridge has a developing device, and is freely attached to and detached from an image forming apparatus. The developing device comprises a toner supply chamber for housing toner; a developing roller, which is provided in the toner supply chamber and applied with bias voltage, and which supplies toner to an image carrier; a toner supply roller, which is provided in the toner supply chamber, and which supplies toner to the developing roller; a toner layer regulation device for forming, in contact with the developing roller, the toner on the developing roller into a thin layer; and an intermediate contact member interposed between the developing roller and the toner supply roller.

In another aspect of the present invention, an image forming apparatus has a developing device. The developing device comprises a toner supply chamber for housing toner; a developing roller, which is provided in the toner supply chamber and applied with bias voltage, and which supplies toner to an image carrier; a toner supply roller, which is provided in the toner supply chamber, and which supplies toner to the developing roller; a toner layer regulation device for forming, in contact with the developing roller, the toner on the developing roller into a thin layer; and an intermediate contact member interposed between the developing roller and the toner supply roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Figure 1:
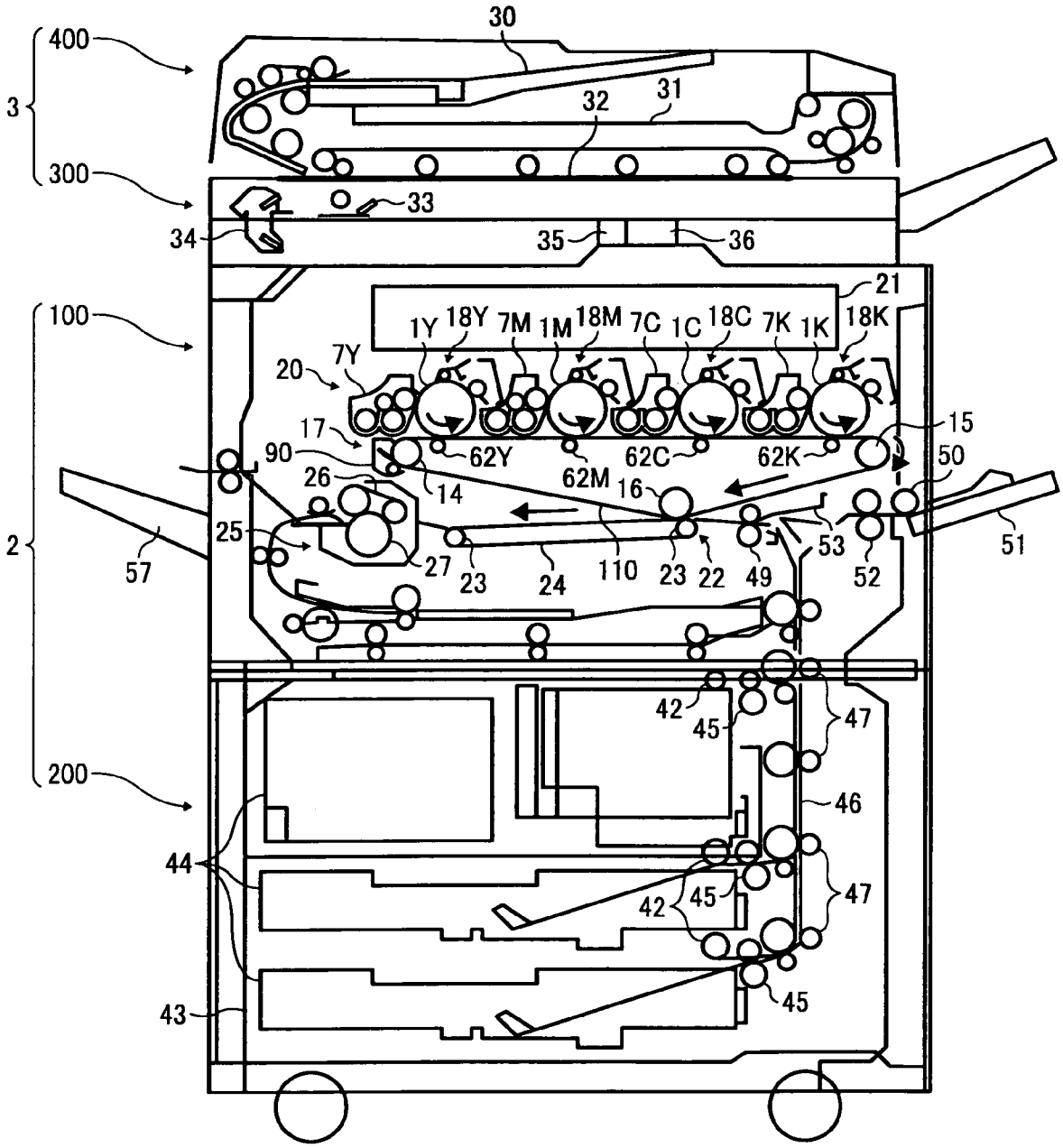
FIG. 1 is a diagram indicating a configuration of an image forming apparatus that applies a developing device of the present invention.

The present invention will be explained in detail below by referring to the drawings.

FIG. 1 indicates the configuration of an image forming apparatus that applies a developing device of the present invention. This image forming apparatus is a copier, and comprises image forming apparatus main unit 2 and pressure plate opening and closing type scanner 3. Multiple image carriers (called photosensitive members) are arranged in parallel inside the image forming apparatus main unit 2. Specifically, this image forming apparatus is a tandem color laser copier. The image forming apparatus main unit 2 comprises a printer unit 100, and a paper feed device 200 mounted on the printer unit 100. An opening and closing pressure plate type scanner 3 comprises a scanner part main unit 300 that is fixed on the printer unit 100, and an automatic manuscript feed device 400 provided to freely rotate on the scanner part main unit 300.

The aforementioned printer unit 100 comprises an image forming unit 20 consisting of four process cartridges 18 of Y, M, C, and K for forming yellow (Y), magenta (M), cyan (C), and black (K) color images. The Y, M, C, and K added to the various code numbers indicate that the members are for yellow, magenta, cyan and black respectively. In addition to process cartridges 18Y, M, C, and K, optical reading unit 21, intermediary transfer unit 17, secondary transfer device 22, and fixing device 25 of the belt fixing system are also arranged in the printer unit 100.

For example, when copying a manuscript, the user sets a stack of the sheet manuscript in a manuscript stand 30 of the automatic manuscript feed device 400. Or, one page of the manuscript is placed on a contact glass 32. When one page is to be set on the contact glass 32 at a time, first the automatic manuscript feed device 400 is rotated upward in relation to the scanner part main unit 300 to expose the contact glass 32. Afterwards, the manuscript page is placed on the contact glass 32, and then the automatic manuscript feed device 400 is rotated downward to secure the manuscript page against the contact glass 32.

After the manuscript page has been set up in this way, the manuscript read operation by the scanner part main unit 300 is begun by pressing the copy start switch. Here, if a sheet manuscript has been set in the automatic manuscript feed device 400, prior to this manuscript read operation, the sheet manuscript is moved to the contact glass 32 by operating the automatic manuscript feed device 400. In the manuscript read operation, first, a first scan member 33 and a second scan member 34 both begin scanning, and light from the light source provided by the first scan member 33 is reflected. Then, the reflected light from the surface of the manuscript is reflected by a mirror provided to the interior of the second scan member 34, passes through a focusing lens 35 and finally falls incident on a reading sensor 36. The reading sensor 36 constructs image data based on the incident light. If a sheet manuscript has been placed on the contact glass 32 by the automatic manuscript feed device 400, the sheet manuscript is discharged to the manuscript discharge part 31.

In parallel with this kind of manuscript reading operation, the various mechanisms inside the process cartridges 18Y, M, C and K, the intermediate transfer unit 17, the secondary transfer device 22, and the fixing device 25 all begin to operate. Then, the drive of the optical writing unit 21 is controlled based on the image data constructed by the read sensor 36, and Y, M, C, and K toner images are formed on the image carriers 1Y, M, C, and K. These toner images are laminated and transferred onto an intermediate transfer belt 110 to make a four-color toner image.

Moreover, at nearly the same time as the manuscript reading operation begins, the paper feed device 200 begins the paper feed operation. In this paper feed operation, one of the multiple paper feed rollers 42 is selectively rotated, and transfer paper is fed out from one of the paper feed cassettes 44 provided in multiple tiers inside a paper bank 43. When feeding out the transfer paper, one sheet of transfer paper is separated at a time by a separation roller 45, and that transfer sheet is introduced into a paper feed route 46 one by one. Afterwards, this sheet is transported to the secondary transfer nip by a pair of transport rollers 47. On the other hand, instead of paper fed from the paper feed cassette 44, paper may be fed in from a manual tray 51. In this case, the manual paper feed roller 50 is selectively rotated, and the transfer paper is fed into the image forming apparatus by the paper feed roller 50. In this case, multiple pages of transfer paper are transported as one unit by the force of friction, but because there is a separation roller 52, the transfer paper is transported one sheet at a time. In this way, one sheet of transfer paper is fed into a manual paper feed route 53 of the printer unit 100.

Configurational elements of this image forming apparatus (optical write unit 21, intermediate transfer unit 17, secondary transfer device 22, and fixing device 25) will be explained below.

First, the optical write unit 21 will be explained. The optical write unit 21 has a light source, polygon mirror, f-θ lens, and reflective mirror, etc., which are not indicated in the diagram, and laser light is reflected onto the surface of the image carrier 1 based on image data. Then, the surface electric potential of the image carrier 1, which has been provisionally charged by a charge device, is attenuated on the parts where the laser light has been reflected. An electrostatic latent image is formed on the surface of the image carrier 1 by this attenuation. The electrostatic latent image formed in this way is developed by the developing device 7 to make a toner image.

Further, the toner image formed on the image carrier 1 undergoes primary transfer to the intermediate transfer belt 110. Because toner remains on the surface of the image carrier 1 after primary transfer, the surface of the image carrier 1 is cleaned by a cleaning device. Then, after passing through a lubricant coating device, the image carrier is electrically neutralized by a neutralizing device, is provisionally charged by the charging device, and returns to the initial state.

Next, the intermediate transfer unit 17 will be explained.

The intermediate transfer unit 17 has an intermediate transfer belt 110 and a belt cleaning device 90. Moreover, the intermediate transfer unit 17 has a following roller 14, a drive roller 15, a secondary transfer roller 16, and four primary transfer rollers 62Y, M, C, and K. The intermediate transfer belt 110 is tensioned across multiple rollers including following roller 14. Then, the intermediate transfer belt 110 operates endlessly by being rotated by the drive roller 15 that is driven by a motor. The four primary transfer rollers 62Y, M, C and K are respectively arranged to make contact with the interior peripheral surface of the intermediate transfer belt 110, and primary transfer bias voltage is applied from a power source not indicated in the diagram. In addition, the primary transfer rollers 62Y, M, C and K form the primary transfer nips by pressurizing the intermediate transfer belt 110 from the interior peripheral surface side toward the image carriers 1Y, M, C and K. Then, primary transfer electric fields are formed between the image carriers 1Y, M, C and K and the primary transfer rollers 62Y, M, C and K (primary transfer nips) based on the effects of the primary transfer bias voltage.

The Y toner image formed on the image carrier 1Y undergoes primary transfer to the intermediate transfer belt 110 based on the effects of this primary transfer electric field and the nip pressure. The M, C and K toner images formed on the image carriers 1M, C and K are laminated on this Y toner image. A four-color laminated toner image (hereafter called "four-color toner image"), which is a multi-layer toner image, is formed on the intermediate transfer belt 110 by this lamination process.

The four-color toner image transferred onto the intermediate transfer belt 110 is transferred to the transfer paper at the secondary transfer nip. After passing through the secondary transfer nip, the intermediate transfer belt 110, which has residual toner on the surface, is squeezed between the following roller 14 and the belt cleaning device 90, and is cleaned here by the belt cleaning device 90.

Next, the secondary transfer device 22 will be explained.

The secondary transfer device 22 is provided below the intermediate transfer unit 17. Moreover, the secondary transfer device 22 comprises a paper transport belt 24 that is tensioned across two tension rollers 23. The paper transport belt 24 moves endlessly as at least one of the tension rollers 23 is driven rotationally. Of the two tension rollers 23, the tension roller 23 arranged on the right side in the diagram sits opposite the secondary transfer roller 16 with the intermediate transfer belt 110 and the paper transport belt 24 in between. The secondary transfer nip is formed with the intermediate transfer belt 110 and the paper transport belt 24 making contact in between. Then, secondary transfer bias voltage with a polarity opposite that of the toner is applied to this tension roller 23 on the right side. By applying this secondary transfer bias voltage a secondary transfer electric field is formed at the secondary transfer nip, which electrostatically moves the toner from the intermediate transfer belt 110 toward the tension roller 23 side. Then, the effects of the secondary transfer electric field and nip pressure cause the four-color toner image to be transferred to the transfer paper that is sent into the secondary transfer nip by a resist roller pair 49 synchronized with the four-color toner image transferred to the intermediate transfer belt 110. Further, instead of the system of applying secondary transfer bias voltage to the tension roller 23, a system of using an electric charger to charge the transfer paper in a non-contact state may also be adopted.

Multiple paper feed cassettes 44 that can store multiple sheets of transfer paper in stacks are arranged perpendicularly at intervals in a paper feed device 200 that is provided in the lower part of the image forming apparatus main unit 2. A paper feed roller 42 presses on the topmost sheet of transfer paper in the paper feed cassette 44. Then, the rotation of the paper feed roller 42 sends the topmost sheet of transfer paper toward a paper feed route 46.

Multiple transport roller pairs 47 are provided in the paper feed route 46 that receives the transfer paper sent out from the paper feed cassette 44 in addition to the resist roller pair 49, which is provided near the end of the paper feed route 46. The transfer paper is transported toward the resist roller pair 49 through the transport roller pairs 47. The transfer paper transported toward the resist roller pair 49 is held between the rollers of the resist roller pair 49. Meanwhile, the four-color toner image formed on the intermediate transfer belt 110 is introduced into the secondary transfer nip as the belt moves endlessly. The resist roller pair 49 sends the transfer paper held between the rollers at a timing that can transfer the four-color toner image at the secondary transfer nip. The four-color toner image on the intermediate transfer belt 110 is thereby transferred to the transfer paper at the secondary transfer nip. The transfer paper on which the full color image is printed in this way moves as the paper transport belt 24 moves endlessly, and is next sent from the paper transport belt 24 to the fixing device 25.

Finally, the fixing device 25 will be explained. The fixing device 25 comprises a belt unit that is a device in which a fixing belt 26 moves endlessly while tensioned by two rollers, and a pressure roller 27 that pressurizes the fixing belt 26. The fixing belt 26 and the pressure roller 27 make mutual contact to form a fixing nip, and the transfer paper that is received from the paper transport belt 24 is held between the nip. Of the two rollers of the belt unit, the roller that is pressurized by the pressure roller 27 comprises an interior heat source not indicated in the diagram, and the fixing belt 26 is heated by heating this roller. The heated fixing belt 26 heats the transfer paper held in the fixing nip. The effects of this heat and the nip pressure fix the full color image on the transfer paper.

The transfer paper that has undergone fixing treatment by the fixing device 25 is discharged into a stack unit 57 that protrudes out from the printer frame plate on the right side in the diagram, or is returned to the secondary transfer nip in order to form a toner image on the other side.

Next, the operation of the image forming apparatus when making multi-color images and monochrome images will be explained.

When multi-color images comprising two or more colors are formed, the intermediate transfer belt 110 is tensioned in an alignment such that the upper part tension surface is nearly horizontal, and all of the image carriers 1Y, M, C and K make contact with the upper part tension surface.

On the other hand, when forming a monochrome image comprising only K toner, the intermediate transfer belt 110 is aligned by a mechanism not shown in the diagram so as to slant down to the left in the diagram, and the upper tension surface is separated from the image carriers 1Y, M and C. Then, only the image carrier 1K from among the four image carriers 1Y, M, C and K is rotated, and only a K toner image is created. In this situation, not only are the image carriers 1 for Y, M and C not driven, but the corresponding developing devices 7 are also stopped.

The image forming apparatus described above comprises a control unit configured by a CPU, etc. that controls the machinery, and an operational display unit configured by a liquid crystal display and various types of key buttons, etc. as indicated in FIG. 1. The user can select the one-sided print mode or double-sided print mode by sending commands to the control unit using key inputs in relation to this operational display unit.

Figure 2:
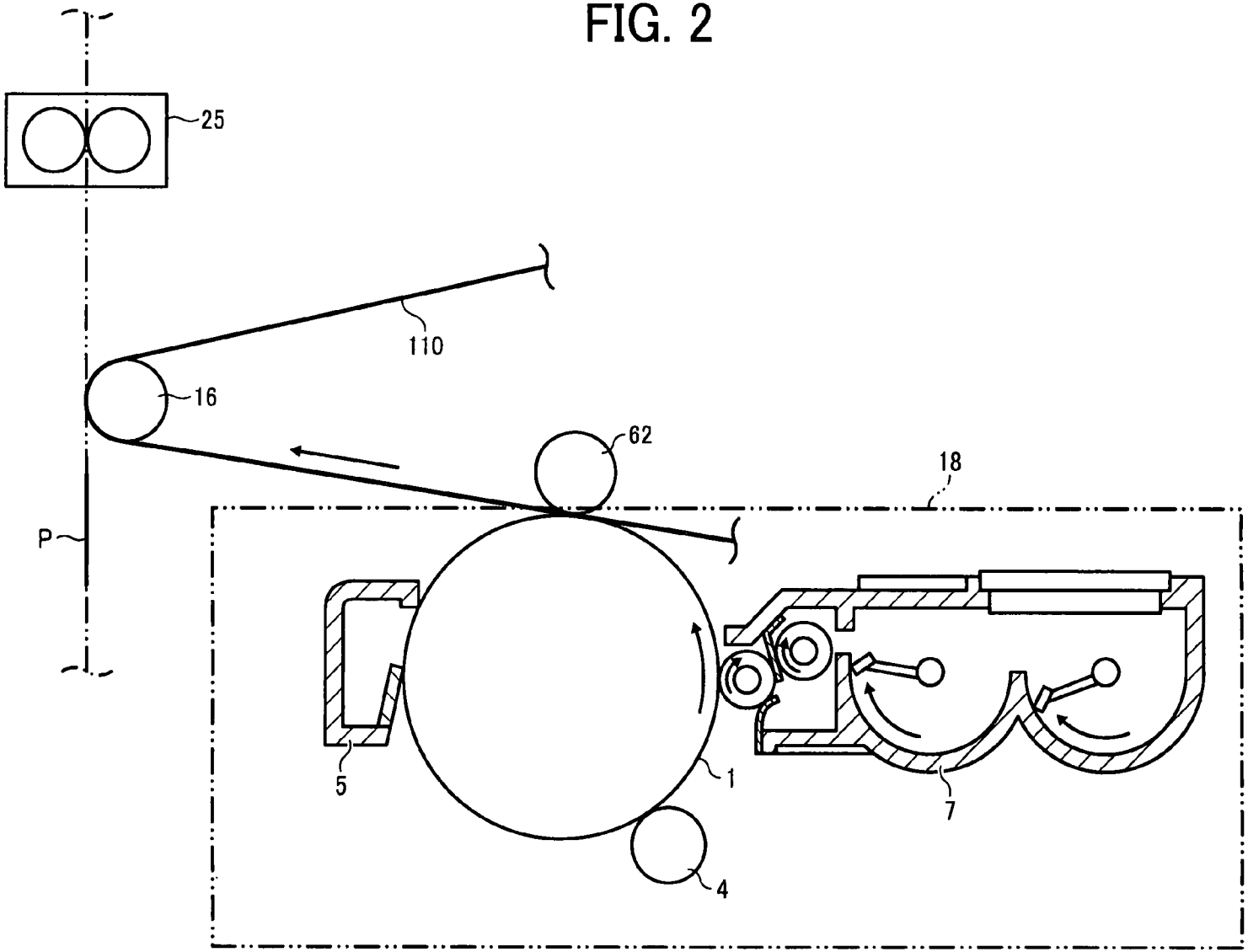
FIG. 2 is a diagram indicating the configuration of a process cartridge comprising a first embodiment of the developing device of the present invention.

FIG. 2 indicates the configuration of a process cartridge comprising the first embodiment of the developing device of the present invention. This process cartridge 18, for example, may be mounted in a monochrome electronic photographic copier, facsimile device, laser printer, or full color laser printer, etc. Developing device 7 is included in the process cartridge of the present invention. Maintenance characteristics can, for example, be cited as an example of the merits of making process cartridges, and if failure is caused by any of the aforementioned parts or devices, quick recovery to the state prior to the image forming apparatus failing can be made just by replacing the process cartridge.

This process cartridge 18 comprises the image carrier 1, developing device 7, charge roller 4 and cleaning device 5. The charge roller 4 makes pressure connection to the surface of the image carrier 1, and rotates by following the rotation of the image carrier 1. A specified bias voltage is applied to the charge roller 4 by a high voltage power source, and the surface of the image carrier is provisionally charged to a specified electric potential. Afterwards, an electrostatic latent image pattern corresponding to a light exposure image made by a light exposure means is formed on the image carrier 1. The electrostatic latent image pattern formed in this way is made visible as a toner image by the adherence of toner supplied from the developing device 7. The cleaning device 5 cleans the toner remaining on the surface of the image carrier after transfer.

Primary transfer bias voltage is applied to the primary transfer roller 62, and the toner image on the surface of the image carrier is transferred to the surface of the intermediate transfer belt 110. A drive motor not indicated in the diagram rotationally drives the intermediate transfer belt 110 in the direction of the arrow in the diagram. The toner image on the surface of the intermediate transfer belt 110 is transferred to the transfer paper P by applying a specified voltage to the secondary transfer roller 16, and the toner image is fixed by the fixing device 25.

Figure 3:
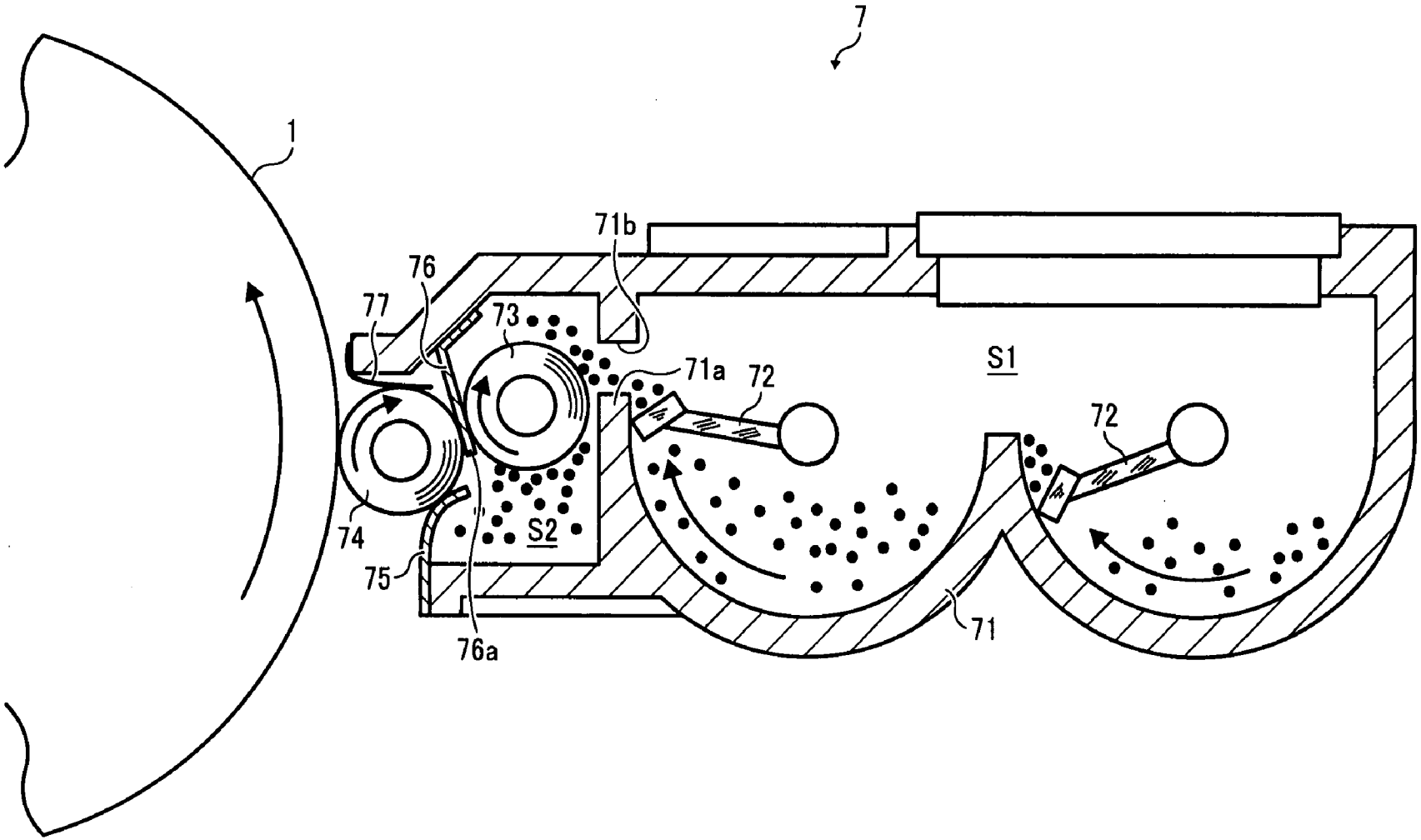
FIG. 3 is a diagram indicating the detailed configuration of the developing device indicated in FIG. 2.

FIG. 3 indicates the detailed configuration of the developing device 7 of FIG. 2. This developing device 7 is a single-component non-magnetic developing device that does with no magnetic carrier in the developer. A toner housing chamber S1 is provided in the interior of the developing device main unit 71 of this developing device 7. This toner housing chamber S1 has two connected bumps. Toner transport members 72 provided in this toner housing chamber S1 rotate clockwise, and send toner housed in the toner housing chamber S1 to the adjacent toner housing chamber S1 on the left side of the diagram, and from the toner housing chamber S1 on the left side to the toner supply chamber S2. An opening 71*b* is formed in a dividing wall 71*a* between the toner housing chamber S1 and the toner supply chamber S2, and operation of the toner transport members 72 move the toner from the toner housing chamber S1 to the toner supply chamber S2 through the opening 71*b*.

A toner supply roller 73 provided on the toner supply chamber S2 is made of a foam material with a structure having cell shaped pores on the surface. The toner supply roller 73 is provided in a position such that an intermediate contact member 76, which is a sheet member, presses into the foam material. The intermediate contact member 76 is fixed at one end. The toner supply roller 73 rotates clockwise, and transports the toner retained by adhering to the surface to the position where the developing roller 74 and the toner supply roller 73 are opposite each other. The intermediate contact member 76 presses in on and deforms the foam material, and the toner supply roller 73 thereby sends the retained toner to the developing roller side and supplies toner to the developing roller 74.

A roller covered with an elastic rubber layer is used for the developing roller 74 that is provided in the toner supply chamber S2 and supplies toner to the image carrier 1. A material easily charged with a polarity opposite that of the toner is further coated on the surface of this elastic rubber layer. In order to prevent deterioration of the toner by pressure concentrated at the contact region using a layer regulation member 75, which is the toner layer regulation means, a substance with a JIS-A hardness of 50 degrees or less is used on the elastic rubber layer. The surface roughness of the elastic rubber layer is an arithmetic mean roughness (Ra) of 0.3 to 2.0 μm, and the necessary amount of toner can be retained on the surface of the elastic rubber layer. Moreover, in order to develop the electrostatic latent image on the image carrier, more concretely, in order to form an electric field between the developing roller 74 and the image carrier 1, a bias voltage is applied to the developing roller 74. The elastic rubber layer is made to have a resistance value of $10^3$ to $10^{10}$ Ω for that purpose. The developing roller 74 rotates clockwise and makes contact with the intermediate contact member 76.

The free end of the intermediate contact member 76 is squeezed between the developing roller 74 and the toner supply roller 73. The toner supply roller 73 and the developing roller 74 do not make contact for that reason. When set up this way, there is no direct contact between the contoured cells of the toner supply roller 73, the surface of which is made of foam material, and the developing roller 74, and therefore no toner scraping irregularities, specifically, no charge irregularities are generated. Continuing, the toner developing characteristics are uniform, there are no light and dark irregularities on the image corresponding to the contoured cells, and a high quality halftone image can be obtained. Moreover, the configuration is simple because the intermediate contact member 76 is configured to be placed between the developing roller 74 and the toner supply roller 73.

Preferably, a pliable resin such as polyethylene terephthalate (PET) or an elastic metal such as stainless steel or phosphor bronze is used for the material of the intermediate contact member 76. If made of pliable or elastic sheet material, the intermediate contact member 76 can be easily inserted between the rollers 73 and 74. In addition, if the amount of pliability or elasticity of the intermediate contact member 76 is controlled by the thickness, then any hampering of the movement of toner from the toner supply roller 73 to the developing roller 74 by the intermediate contact member 76 can be prevented.

The layer regulation member 75 is provided in a position lower than that of the contact position between the toner supply roller 73 and the developing roller 74. A sheet metal spring material such as stainless steel or phosphor bronze may be used for the layer regulation member 75, and the free end of the layer regulation member 75 makes contact with the surface of the developing roller 74 at a pressurized force of 10 to 50 N/m. The layer regulation member 75 imparts a charge to the toner by triboelectric charging as the toner is made into a thin layer. Further, in order to supplement the triboelectric charge, in addition to voltage of the same value as that of the bias voltage applied to the developing roller 74, regulation bias voltage of a value offset in the same direction as the charge polarity of the toner is applied to the layer regulation member 75.

The image carrier 1 rotates counterclockwise, and at the position opposite that of the image carrier 1, the surface of the developing roller 74 moves in the same direction as the direction of advance of the image carrier 1. The toner that has been made into a thin layer is transported to a position opposite that of the image carrier 1 by the rotation of the developing roller 74. Here, the toner is moved to the surface of the image carrier by the latent image electric field formed between the bias voltage applied to the developing roller 74 and the electrostatic latent image on the image carrier. Development takes place when the toner moves to the image carrier 1.

Toner that does not move to the image carrier 1 and remains on the developing roller 74 is recovered to the toner supply chamber S2. At the region of the inlet for returning the toner, which is remained on the surface of the developing roller 74, to the toner supply chamber S2, an inlet seal 77 is provided in contact with the developing roller 74. This inlet seal 77 prevents the toner of the toner supply chamber S2 from leaking outside of the developing device 7.

In FIG. 3, the developing roller 74 and the image carrier 1 make contact, it is also possible that the developing roller 74 and the image carrier 1 do not make contact. Moreover, the image carrier 1 indicated in the diagram has a drum shape, but the shape is not limited to this and may be, for example, a belt shape.

Figure 4:
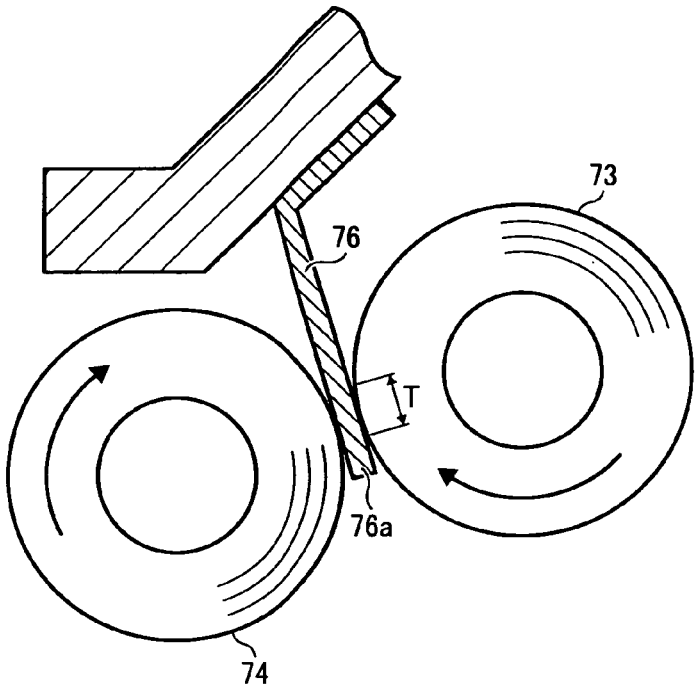
FIG. 4 is a diagram indicating the configuration near the intermediate contact member indicated in FIG. 3.

FIG. 4 indicates the configuration near the intermediate contact member 76 indicated in FIG. 3. One end of the intermediate contact member 76 is secured to the developing device main unit 71, and the free end is placed in nip part T between the developing roller 74 and the toner supply roller 73. However, it is necessary to provide a route for supplying toner retained by adhering to the surface of the toner supply roller 73 to the surface of the developing roller 74, and therefore the free end of the intermediate contact member 76 slightly protrudes from the nip part T between the developing roller 74 and the toner supply roller 73. In other words, the intermediate contact member 76 protrudes out further than where the contact point between the developing roller 74 and the toner supply roller 73 would be if there were no intermediate contact member. The length of this protrusion is enough to cover and hide the toner supply roller surface at the nip part T, and is a length that can supply toner from the toner supply roller 73 to the developing roller 74. If the intermediate contact member 76 covers and hides the toner supply roller surface at the nip part T, then the contours of the foam cells of the toner supply roller 73 can be prevented from contacting and scraping the toner thin layer on the surface of the developing roller. Moreover, because this is a length at which the toner can be supplied from the toner supply roller 73 to the developing roller 74, even with the intermediate contact member 76 present, the toner can be precisely moved from the toner supply roller 73 to the developing roller 74. If the length of protrusion of the intermediate contact member 76 from the nip part T is too great, the toner cannot be moved from the toner supply roller 73 to the developing roller 74, and therefore the length of protrusion may be suitably determined by considering the thickness of the intermediate contact member 76 and the sizes of the roller 73 and the roller 74, etc.

In addition, the force of friction between the developing roller 74 and the intermediate contact member 76 is larger than the force of friction between the toner supply roller 73 that is coated with foam material and the intermediate contact member 76, and therefore in order to prevent the bending of the sheet-shaped intermediate contact member 76, the free end 76*a* of the intermediate contact member 76 protrudes out downstream in the direction of rotation of the developing roller 74. On the other hand, in order to supply toner from the toner supply roller 73 to the developing roller 74 the free end 76*a* of the intermediate contact member 76 must be arranged upstream in the direction of rotation of the toner supply roller 73, and therefore the toner supply roller 73 rotates clockwise. Specifically, at the nip part T between the developing roller 74 and the toner supply roller 73, the direction of movement of the peripheral surface of the developing roller 74 is mutually opposite the direction of movement of the peripheral surface of the toner supply roller 73.

Figure 5:
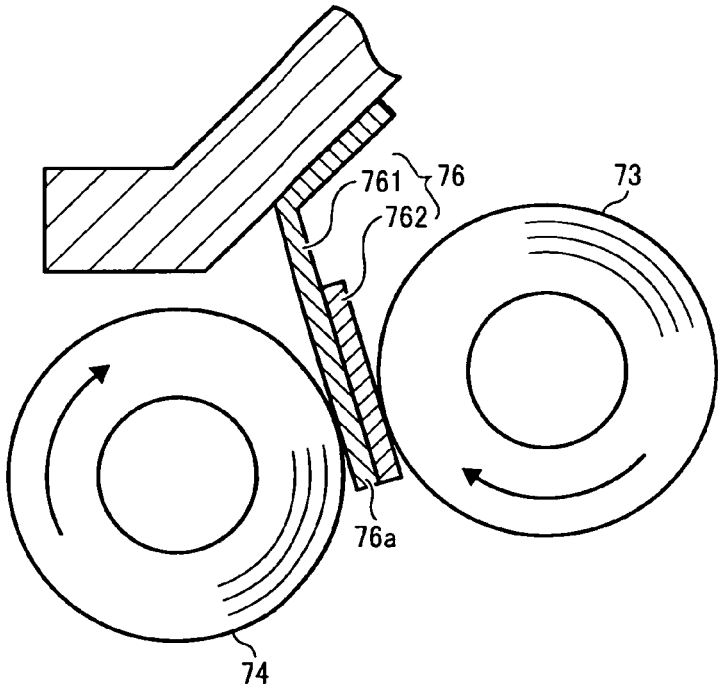
FIG. 5 is a diagram indicating the configuration of a second embodiment of the developing device of the present invention.

FIG. 5 indicates the configuration of a second embodiment of the developing device of the present invention. Further, the drawing indicates that the thickness of the intermediate contact member 76 is actually even greater in this embodiment. As indicated in the diagram, the intermediate contact member 76 has a two layer construction in which an affixed sheet 762 is affixed to the sheet-shaped substrate 761. The same material as that of the first embodiment may be applied to the material of the substrate 761. Specifically, for example, PET sheet may be used. A material with a smaller coefficient of friction than that of the toner supply roller 73 may be suitably selected for the material of the affixed sheet 762. Concretely, a fluorinated resin such as polytetrafluoroethylene (PTEF) may be used.

If a material such as a fluorinated resin that has a smaller coefficient of friction than that of the toner supply roller 73 is suitably selected for the material of the affixed sheet 762 of the intermediate contact member 76, which has contact with the toner supply roller 73, then there will be a smaller force of friction between the toner supply roller 73 and the intermediate contact member 76, and therefore the intermediate contact member 76 detaching from the nip part T (FIG. 4) and the bending of the intermediate contact member 76 linked to the rotation of the toner supply roller 73 can be reliably prevented. Moreover, the stability of the position of the free end 76*a* is improved because sufficient force linked to the rotation of the developing roller 74 is exercised in the direction pulling toward the free end.

Figure 6:
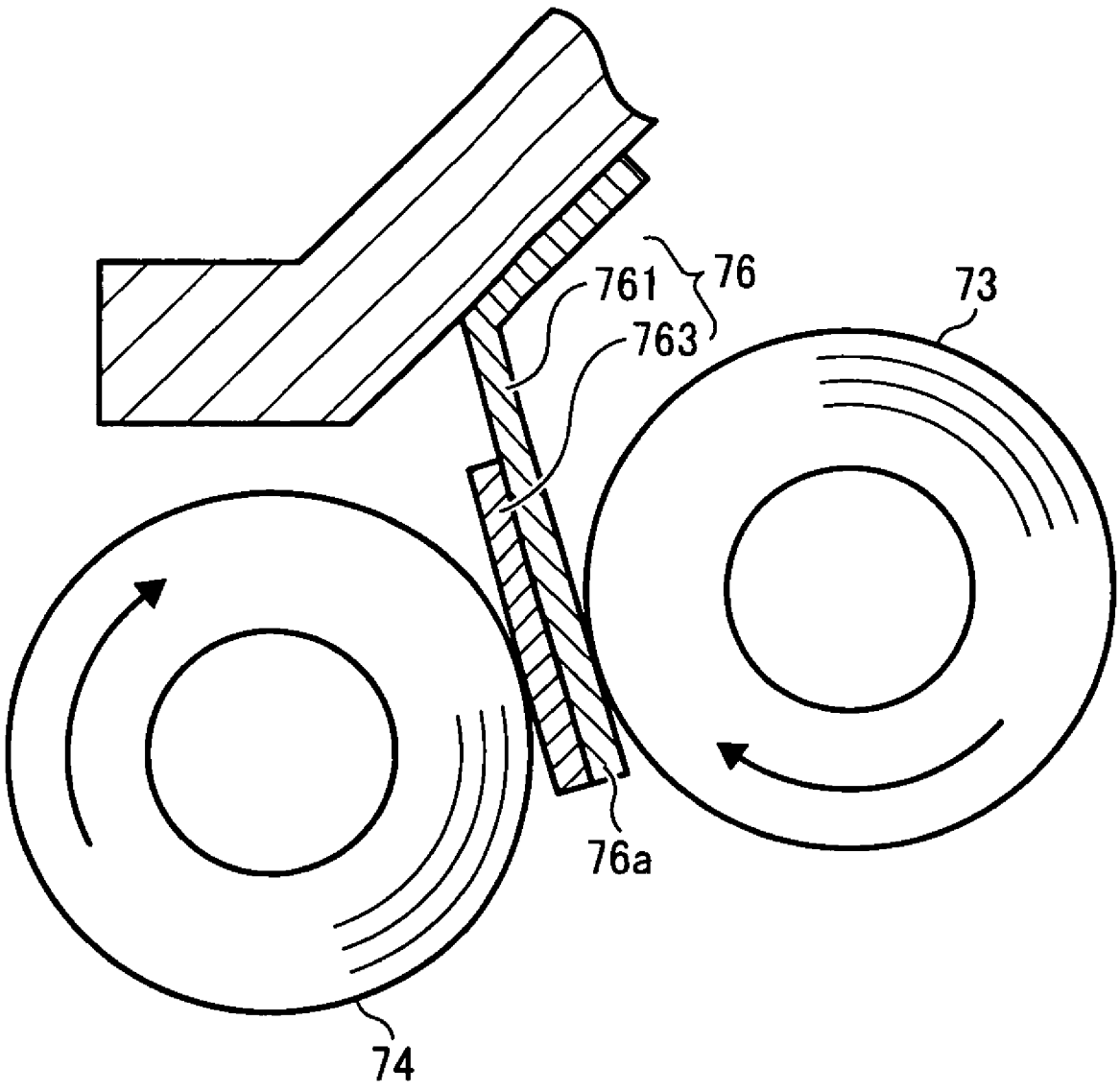
FIG. 6 is a diagram indicating the configuration of a third embodiment of the developing device of the present invention.

FIG. 6 indicates the configuration of a third embodiment of the developing device of the present invention. Further, the drawing indicates that the thickness of the intermediate contact member 76 is actually even greater. As indicated in the diagram, the intermediate contact member 76 has a two layer construction in which an elastic sheet 763 is affixed on top the sheet-shaped substrate 761. The same material as that of the first embodiment may be applied to the material of the substrate 761. Specifically, for example, PET sheet may be used. An elastomeric resin such as urethane rubber, silicone rubber or ethylene-propylene rubber may be used for the material of the elastic sheet 763. The elastic sheet 763 is affixed to the side that contacts the developing roller 74.

In this way, when an elastomeric resin is used for the material of the contact surface between the intermediate contact member 76 and the developing roller 74, the surface of the elastic sheet 763 vibrates during the operation of the developing device 7, and adhesion of the toner can be reliably prevented. If toner adheres to the surface of the developing roller side of the intermediate contact member 76, there is the possibility of streaks being generated in the image by the toner thin layer on the surface of the developing roller being disrupted, but this phenomenon can be reliably prevented. Moreover, because abrasion of the surface of the elastomeric resin is prone to occur, and because even adhering toner does not hold up, the surface of the elastic sheet 763 is refreshed, and toner fixation buildup can be prevented.

Figure 7:
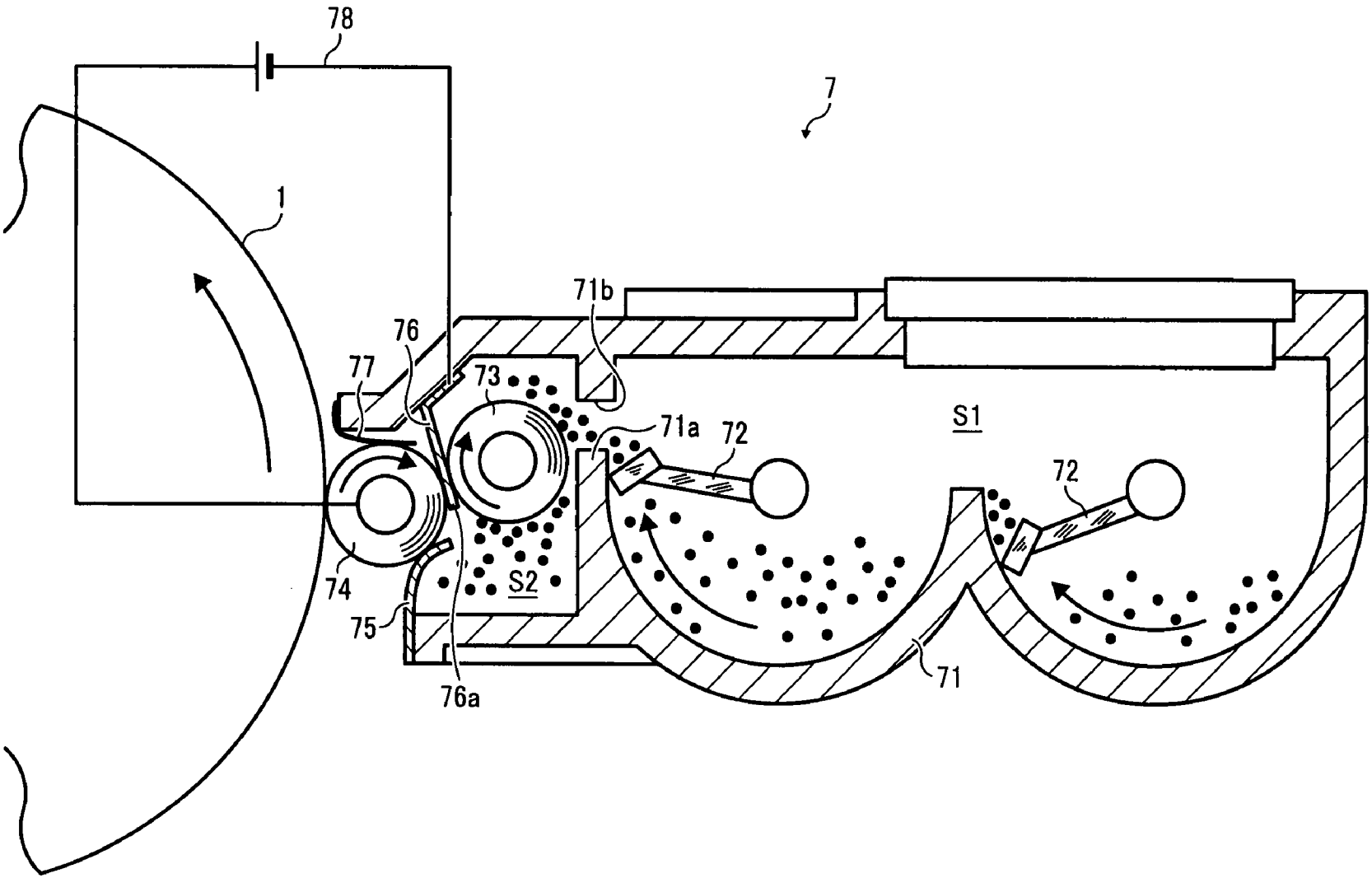
FIG. 7 is a diagram indicating the configuration of a fourth embodiment of the developing device of the present invention.

FIG. 7 indicates the configuration of a fourth embodiment of the developing device of the present invention. Resin sheet given conductive characteristics or a conductive metal thin plate having spring characteristics such as stainless steel or phosphor bronze may be used for the intermediate contact member 76. More concretely, for example, polyethylene sheet adjusted to a resistance value of $10^5$ to $10^6$ Ω by dispersing carbon black can be used. In order to energize the toner from the intermediate contact member 76 to the developing roller 74 side, voltage application means 78 applies to the intermediate contact member 76 a bias voltage of a value offset in the same direction as the toner charge polarity. Further, the entire intermediate contact member 76 does not have to be configured by a conductive material, and conductive sheet and non-conductive sheet may be laminated. Specifically, as long as the toner can be energized to the developing roller 74 side, then it is not necessary for the entire intermediate contact member 76 to be conductive, and only part may be made of a conductive material.

If energizing the toner to the developing roller 74 side in this way, the toner will not become fixed on the intermediate contact member 76, and therefore generation of streaks on the image by disruption of the toner thin layer on the surface of the developing roller can be prevented.

As explained above, according to the present invention toner can be reliably supplied from the toner supply roller to the developing roller, and no scraping irregularities are produced in the toner thin layer on the developing roller.

Various modifications will become possible for those skilled in the art after receiving the teachings of the present disclosure without departing from the scope thereof.

What is claimed is:

1. A developing device for developing electrostatic latent images on an image carrier, comprising:

a toner supply chamber for housing toner;

a developing roller, which is provided in the toner supply chamber and applied with bias voltage, and which supplies toner to the image carrier;

a toner supply roller, which is provided in the toner supply chamber, and which supplies toner to the developing roller;

a toner layer regulation member that forms, in contact with the developing roller, the toner on the developing roller into a thin layer; and an intermediate contact member interposed between the developing roller and the toner supply roller.

2. The developing device according to claim 1, wherein the intermediate contact member is a sheet member fixed at one end, and a free end side of the sheet member is interposed between the developing roller and the toner supply roller.

3. The developing device according to claim 2, wherein the free end side of the intermediate contact member protrudes from a nip part between the developing roller and the toner supply roller such that the toner is moved from the toner supply roller to the developing roller.

4. The developing device according to claim 1, wherein the intermediate contact member has a two-layer structure.

5. The developing device according to claim 1, wherein a material of the intermediate contact member on a surface in contact with the toner supply roller is a fluorinated resin.

6. The developing device according to claim 1, wherein a material of the intermediate contact member on a surface in contact with the developing roller is an elastomeric resin.

7. The developing device according to claim 1, wherein all or part of the intermediate contact member is formed of a conductive material, and a voltage application device that applies bias voltage of the same polarity as a charge polarity of the toner to the intermediate contact member is provided.

8. The developing device according to claim 1, wherein the intermediate contact member is attached to a housing of the developing device.

9. The developing device according to claim 1, wherein the developing roller is in contact with the image carrier.

10. A process cartridge, which has a developing device, and which is freely attached to and detached from an image forming apparatus, wherein the developing device comprises:

a toner supply chamber for housing toner;

a developing roller, which is provided in the toner supply chamber and applied with bias voltage, and which supplies toner to an image carrier;

a toner supply roller, which is provided in the toner supply chamber, and which supplies toner to the developing roller;

a toner layer regulation member that forms, in contact with the developing roller, the toner on the developing roller into a thin layer; and an intermediate contact member interposed between the developing roller and the toner supply roller.

11. An image forming apparatus having a developing device, wherein the developing device comprises:

a toner supply chamber for housing toner;

a developing roller, which is provided in the toner supply chamber and applied with bias voltage, and which supplies toner to an image carrier;

a toner supply roller, which is provided in the toner supply chamber, and which supplies toner to the developing roller;

a toner layer regulation member that forms, in contact with the developing roller, the toner on the developing roller into a thin layer; and an intermediate contact member interposed between the developing roller and the toner supply roller.

* * * * *